US005938490A

United States Patent [19]

Rodler

[11] Patent Number: 5,938,490

[45] Date of Patent: Aug. 17, 1999

[54] OUTBOARD MARINE PROPULSION SYSTEM

[76] Inventor: Waldo E. Rodler, 1488 Cherry Garden La., San Jose, Calif. 95125-4843

[21] Appl. No.: 09/003,769

[22] Filed: Jan. 7, 1998

[51] Int. Cl.[6] ..... B63B 1/24; B63H 11/11

[52] U.S. Cl. ..... 440/41; 114/279

[58] Field of Search ..... 440/88, 89, 47, 440/111, 52, 38, 39, 41; 114/279; 60/221, 222

[56] References Cited

U.S. PATENT DOCUMENTS

| | | | |
|---|---|---|---|
| 1,301,917 | 4/1919 | De Bolotoff | 114/279 |
| 3,336,752 | 8/1967 | Smith | 60/221 |
| 3,747,549 | 7/1973 | Shutt | 114/39 |
| 3,809,005 | 5/1974 | Rodler, Jr. | 115/12 |
| 3,970,027 | 7/1976 | Jackson | 114/151 |
| 4,073,257 | 2/1978 | Rodler, Jr. | 115/12 |
| 4,281,996 | 8/1981 | Mouraret | 440/89 |
| 4,304,558 | 12/1981 | Holtermann | 440/67 |
| 4,597,354 | 7/1986 | Gelula | 114/343 |
| 4,897,059 | 1/1990 | Newman | 440/88 |
| 5,472,359 | 12/1995 | Allbright, Jr. et al. | 440/38 |
| 5,520,558 | 5/1996 | Kobayashi | 440/38 |
| 5,813,887 | 9/1998 | Mark | 440/5 |

*Primary Examiner*—Sherman Basinger
*Assistant Examiner*—Patrick Muldoon
*Attorney, Agent, or Firm*—Jeffrey A. Hall

[57] ABSTRACT

An improved outboard propulsion system for a vessel in which an intake duct having an intake orifice positioned for receiving water. The intake duct includes a curved flow path directing walls curved continuously to provide a 180 degree turn for the water so as to direct the water flowing in an initial direction to a direction opposite the initial direction. An annular duct contiguous with the intake duct at the end of the intake duct is positioned opposite the intake orifice. The annular duct has walls curved continuously to provide a second substantially 180 degree turn to direct water flowing therethrough through a continuous change in direction of substantially 180 degrees such that the water is flowing in a direction approximate that of its initial direction at the intake orifice and substantially opposite the direction to which it entered the annular duct. An impeller discharges into a mixed flow volute. The discharge from the volute is split into two passages that transfer the water to two annular jet outlets which surround exhaust ports. The system utilizes an engine with a horizontal crankshaft, a belt or chain transfer drive to drive a propulsion device such as a propeller or waterjet, and a transfer case connecting the engine and the belt or chain transfer drive.

17 Claims, 3 Drawing Sheets

OUTBOARD MARINE PROPULSION SYSTEM

BACKGROUND OF THE INVENTION

1. Field of Invention

This invention relates in general to propulsion systems, and more particularly to outboard propulsion systems for water vehicles.

2. Description of the Related Art

Various propulsion systems have been proposed and implemented for different boats and particularly boats having planing type hulls. Numerous outboard engines have been developed with a series of holes and movable pins to provide for the adjustment of the thrust line angle which is known to provide improved performance in propulsion systems. Different inboard/outboard propulsion systems have employed complex electro-hydraulic systems and electromechanical systems to adjust the thrust line angle for improved performance. Additionally, the inboard/outboard propulsion systems have employed a series of holes and movable pins used with hydraulic power trim systems for adjusting the thrust line angle for improved performance. Tilt cylinders have also been used in the past. In jet propulsion systems, there were significant limitations in adjustment means, utilizing either a manual adjustment or a power adjustment. Typically, as part of a jet propulsion system, a complex and cumbersome electro-hydraulic and electromechanical system were employed for adjusting the thrust angle for improved performance.

Utilized in prior attempts was the knowledge that the efficiency of a jet propulsion system is related to the size of the nozzle. Large nozzles allow a maximum flow rate of water which results in maximized propulsion efficiency. Also recognized was that a reduced nozzle size minimizes the tendency to cavitate which can cause a serious loss of performance at lower speed ranges, i.e. 5 to 22 miles per hour. A conventional nozzle is generally arranged to minimize the size of the nozzle and the flow rate of water to prevent cavitation. The cavitation failure resulted in greater fuel consumption, more engine noise and greater wear and tear on the engine.

Water jet propulsion systems have been disclosed in the following U.S. Patents:

U.S. Pat. No. 3,336,752 issued to M. S. Smith on Aug. 22, 1967;

U.S. Pat. No. 3,283,737 issued to C. A. Gongwer on Nov. 8, 1966;

U.S. Pat. No. 3,212,258, issued to C. A. Gongwer on Oct. 19, 1965;

U.S. Pat. No. 3,575,127 issued to G. F. Wislicenus on Apr. 13, 1971.

The applicant of the present invention Waldo E. Rodler has two prior patents U.S. Pat. Nos. 3,809,005 and 4,073,257 related in part to the present disclosure. U.S. Pat. No. 3,809,005 discloses a shield or deflector for reversing the direction thrust included an annular configuration and a series of arc-shaped forward jet ports which produced an essentially annular jet. Such annular jets were not totally effective in clearing foreign matter entrained in the water about the intake duct. The deflector was not fully effective in controlling reverse water flow. U.S. Pat. No. 4,073,257 was an improved propulsion system where a jet propulsion system used a spring to control the angle or tilting of the thrust and use of a hydraulic cylinder between a tilt stop and a mounting bracket.

Accordingly, it is the primary object of this invention to provide an improved outboard jet propulsion system with a horizontal crankshaft engine utilizing a belt or chain transfer drive. The present invention also discloses a two nozzle outboard system using the aforementioned belt or chain transfer drive, height adjustment system, thrust angle vector positive and automatic control, water lubricated bearings, and a vented pulley which reduces pumping power losses, and which is highly efficient, safe, and quiet during operation.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, an improved outboard propulsion system is provided for a vessel in which an intake duct having an intake orifice is positioned for receiving water. The intake duct includes a curved flow path directing walls curved continuously to provide a substantially 180 degree turn for the water so as to direct the water flowing from an initial direction to a direction opposite the initial direction. An annular duct contiguous with the intake duct at the end of the intake duct is positioned opposite the intake orifice. An impeller discharges into a mixed flow volute. The discharge from the volute is split into two passages that transfer the water to two annular jet outlets which surround exhaust ports. The system utilizes an engine with a horizontal crankshaft, a belt or chain transfer drive to drive a propulsion device such as a propeller or waterjet, and a transfer case connecting the engine to the propulsion device.

The principal improvements include an engine with the crankshaft positioned horizontally, a novel pump means mounted with the shaft horizontally positioned, a unique nozzle and waterjet configuration, and a toothed chain or belt transfer drive connected by a transfer case that encloses the belt or chain. The present invention provides thrust vector positive control, thrust vector automatic control, dual nozzle waterjets with positive priming means and a very quiet and efficient exhaust apparatus. Further means are provided to prevent water from being pumped into the engine's exhaust, an improved height and thrust vector system, means for allowing water lubrication of the bearings, and a vented pulley system which reduces pumping power losses in cases when the transfer case becomes partially or fully flooded with water.

In accordance with the invention there is also provided an improved outboard propulsion system for a vessel of the type in which an intake duct is supported for movement between an upward tilt angle and a downward tilt angle, apparatus connected to the duct support defines a reaction center line to urge the duct in a downward tilt angle through a downward progressive thrust, connecting apparatus connected to the duct support and define a thrust center line disposed below the reaction center line to urge the duct in an upward tilt angle through an upward reaction force, a fixed member, and a tilt angle device interconnecting the intake duct and the fixed member for regulating the tilt angle movement of the intake duct in the changeover between an upward tilt angle and the downward tilt angle. The improvement comprises, utilizing an engine having a horizontal crankshaft and a chain transfer drive means for driving a propulsion device. A transfer case connects the engine and the chain transfer drive means. The transfer case preferably is configured enclosing the chain transfer drive means.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Figure 2:
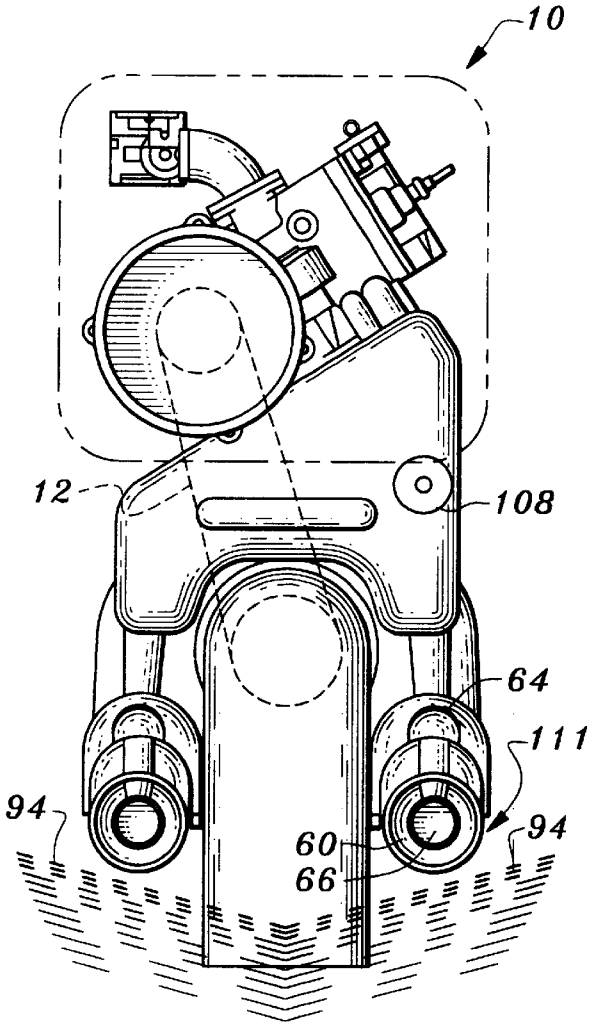
FIG. 2 is an end view of such system showing the exhaust and annular jet outlets, according to the invention.

Reference will now be made in detail to the present preferred embodiments of the invention as illustrated in the accompanying drawings.

In accordance with the present invention, there is provided in a preferred embodiment of the invention, an improved outboard propulsion system for a vessel in which an intake duct having an intake orifice positioned for receiving water. The intake duct includes a curved flow path directing walls curved continuously to provide a substantially 180 degree turn for the water so as to direct the water flowing in an initial direction to a direction opposite the initial direction. An annular duct contiguous with the intake duct at the end of the intake duct is positioned opposite the intake orifice. An impeller discharges into a mixed flow volute. The discharge from the volute is split into two passages that transfer the water to two annular jet outlets which surround exhaust ports. The system utilizes an engine with a horizontal crankshaft, a belt or chain transfer drive to drive a propulsion device such as a propeller or waterjet, and a transfer case connecting the engine to the propulsion device.

There is also, in accordance with the present invention, provided an improved an improved outboard propulsion system for a vessel of the type in which an intake duct is supported for movement between an upward tilt angle and a downward tilt angle, apparatus connected to the duct support defines a reaction center line to urge the duct in a downward tilt angle through a downward progressive thrust, connecting apparatus connected to the duct support and define a thrust center line disposed below the reaction center line to urge the duct in an upward tilt angle through an upward reaction force, a fixed member, and a tilt angle device interconnecting the intake duct and the fixed member for regulating the tilt angle movement of the intake duct in the changeover between an upward tilt angle and the downward tilt angle, wherein the improvement comprises, an engine having a horizontal crankshaft, a chain transfer drive means for driving a propulsion device, the chain transfer drive means being operably linked to the engine; and a transfer case connecting the engine and the propulsion device. The transfer case preferably enclosing the chain transfer drive means.

The principal improvements of the present outboard marine propulsion system as illustrated in FIGS. 1–6 comprise an engine 10 with a crankshaft mounted in a horizontal position, a toothed belt or chain 12 within a transfer case 14 used to drive a jet propulsion unit 16 and a mounting 18. Other components such as housing 20, exhaust muffler 22, piping 24, carrying handle 28, steering tiller 30, and other components described in detail below complete the new and improved system.

Figure 1:
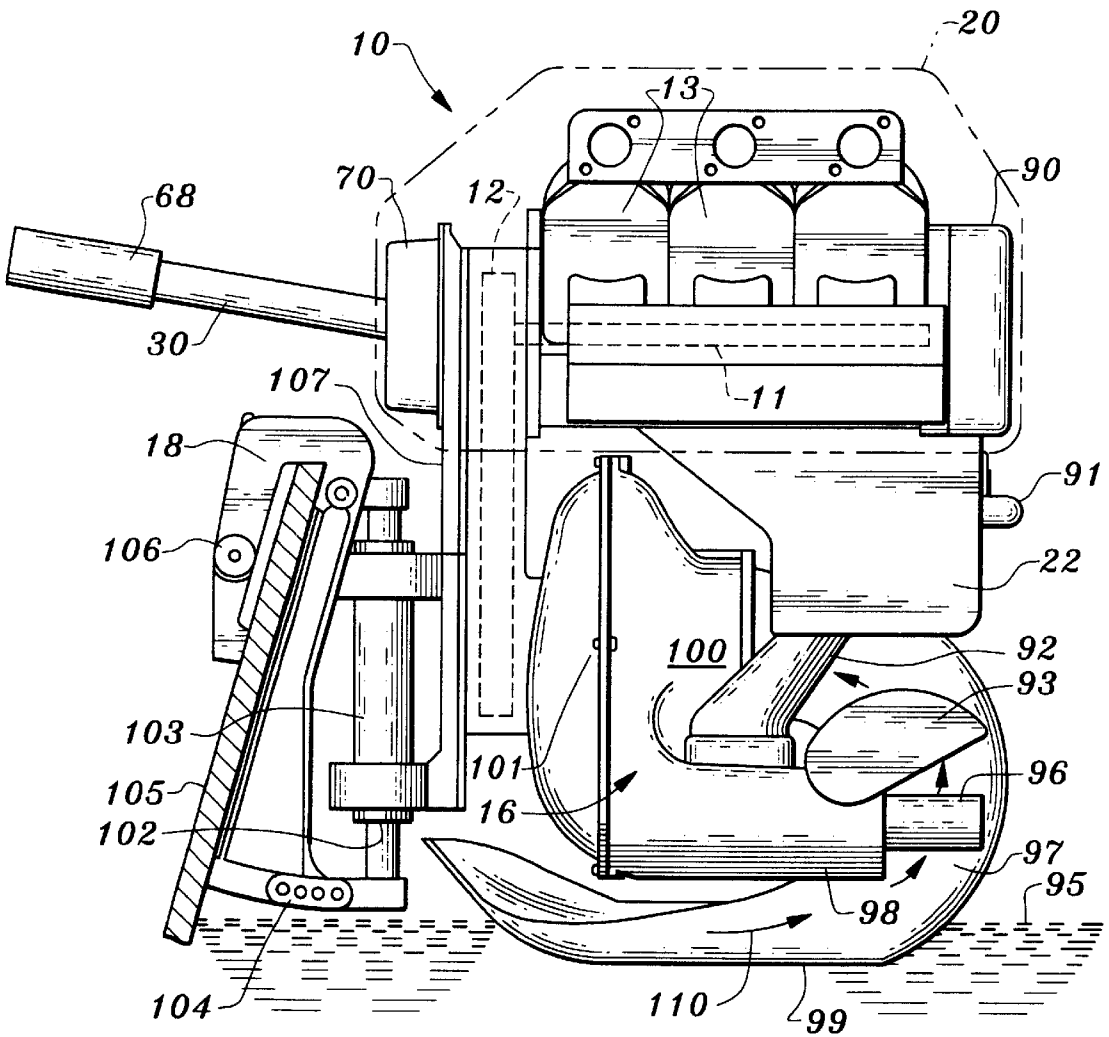
FIG. 1 is a side elevational view of an outboard marine propulsion system, according to the invention.

In FIG. 1, engine 10 is shown with crankshaft 11 operably mounted in a horizontal position. This attitude reduces the overall height of the system and allows for simplification of the transfer drive described below. Preferably engine 10 is mounted in a slanted attitude as shown in FIG. 2. This attitude results in a further reduction in height without exceeding a system width that is determined by the jet drive system. Mounting in this attitude also improves clearing the engine of any water after the unit has been submerged by placing the exhaust in the lowest possible position. The use of horizontal crankshaft 11 permits this use of a toothed belt or chain transfer drive 12 as seen in FIG. 2 in place of the complex system of gears, shafts, clutches, and bearings used in a conventional outboard engine.

Engine 10 preferably has three cylinders 13. Any two cycle engine is very sensitive to the effects of the exhaust system. Large tuned exhaust systems are need to achieve the effective scavenging that is essential for producing the reasonable high break mean effective pressures (BMEP) that are essential in a light weight engine. It is a unique consideration of the three cylinder arrangement that if the three cylinders are connected to a simple exhaust manifold, the exhaust pulses can be timed to augment each other, eliminating the need for the tuned resonators. The BMEP that can be sustained for reasonable periods is limited by detonation. Small cylinders shorten the distance the flame front must travel an therefore are less subject to detonation. For similar displacements, a three cylinder engine can therefore operate at a higher BMEP and produce more power. In these ways, a three cylinder engine can produce a required power with a lower volume and weight than an equally powerful two cylinder engine.

In FIG. 1, engine 10 with horizontal crankshaft 11 is shown in housing 20 with ignition housing 90. Muffler 22, carrying handle 91, exhaust pipes 92, engine exhaust 96, intake elbow 97, nozzle housing 98, and reverse bucket 93 which is shown in a forward position, and which lowers ninety degrees to reverse thrust, are shown above planing water line 95.

Figure 3:
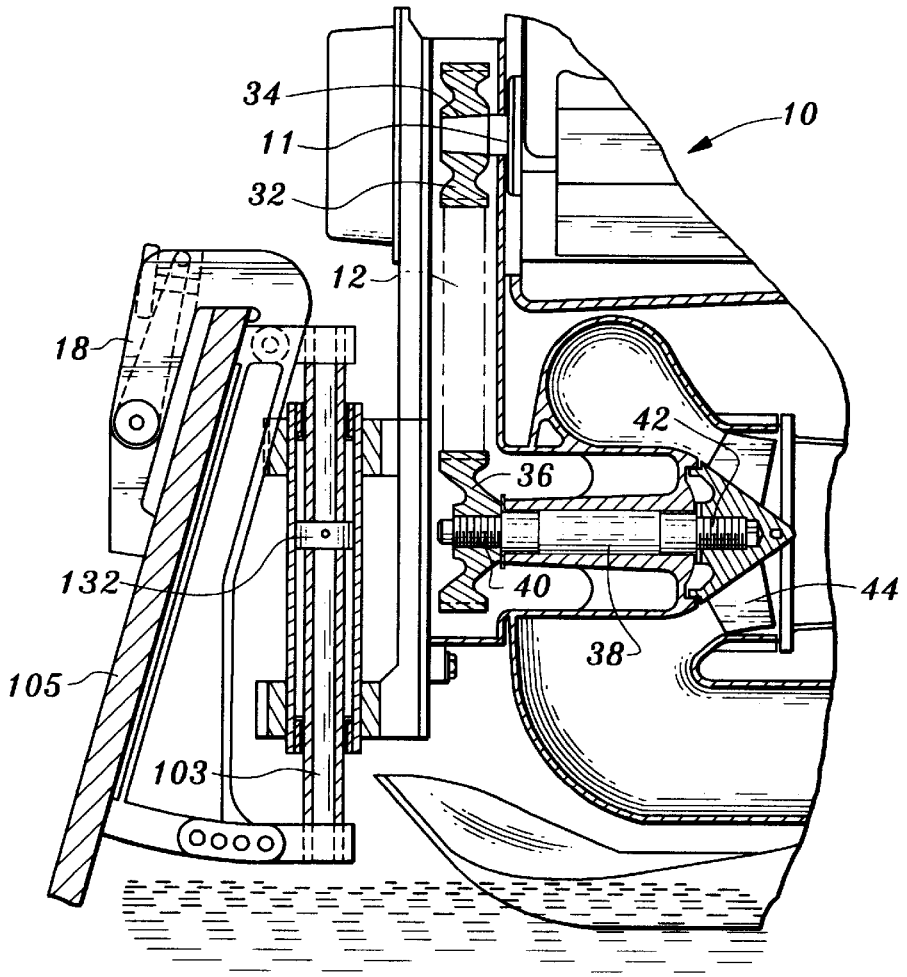
FIG. 3, is a sectional view showing the transfer drive of such system, according to the invention.
Figure 4:
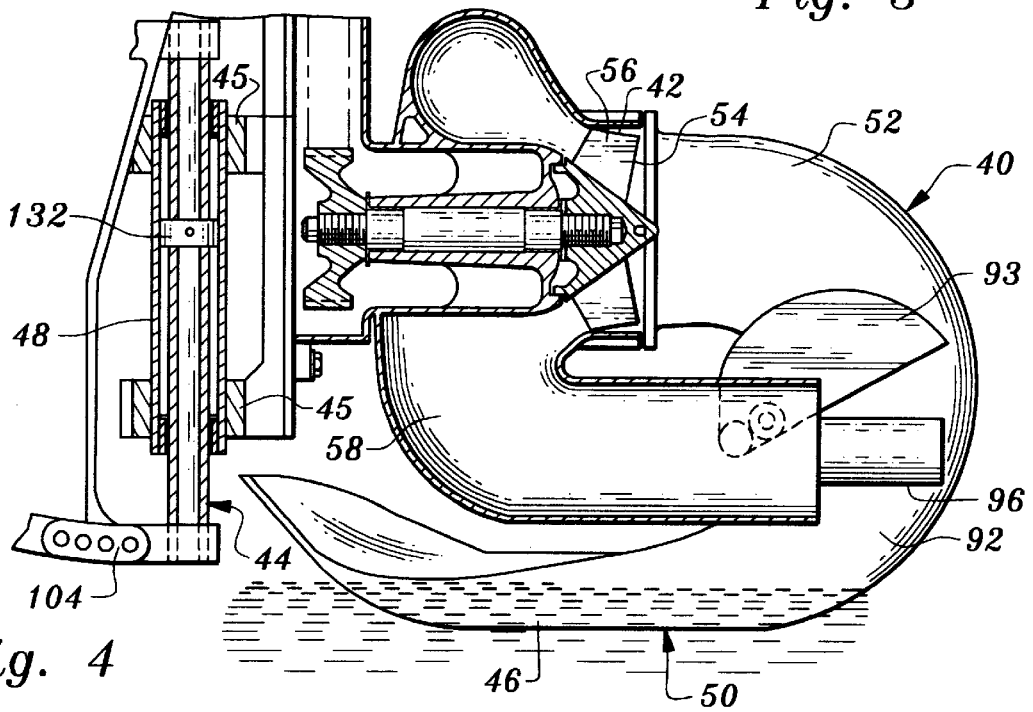
FIG. 4, is a view of the waterjet configuration of such system, according to the invention.

A water inlet 99 opening to curved flow path 110 is shown below pump housing 100 and volute 101. Jet propulsion assembly 16 is shown operably linked to nozzle housing 98. Tilt adjustment 104 is operably linked to sliding mount 102 by bolts, screw, or other fastening means. Damper 103 is shown in communicative linkage to sliding mount 102 and piston 132 as shown in FIGS. 3 and 4. Transom 105 with transom clamp 106 is operably secured to mounting assembly 18. Transfer case 107 connects engine 10 and belt or chain transfer drive 12 to water jet 16, preferably enclosing the chain or belt transfer drive 12. Fold down tiller 30 with twist throttle 68 are shown with recoil starter 70 mounted to transfer case 107. In one embodiment, engine 10 may be mounted to a boat by a pair of ball joints 82 positioned on a pair of shafts 80 seen in FIG. 6.

With reference now to FIG. 2, engine 10 is shown with exhaust relief 108 and nozzle 111 with exhaust outlet 66 and annular jet outlet 60 above planing water line 94. Preferably, two annular jet outlets 60 provide dual waterjets with concentric exhaust outlet 60 positioned therein.

In FIG. 3, toothed belt or chain 12 transfer drive is used providing the advantages of light weight, low noise, non magnetic construction, no lubrication requirements and dependability. Driving pulley 32, preferably hard coated aluminum, is directly attached to engine crankshaft 11 by means of a tapered shaft mounting 34. The engine crankshaft bearing has ample capacity to carry the belt tension in such a configuration.

Driven pulley 36 is preferably mounted to the waterjet main shaft 38 by means of a screw thread 40. A similar screw thread mounting 42, is used on the opposite end of the main shaft to mount pump impeller 44. Such configuration is suitable for the use of an aluminum silicon carbide metallic matrix material for the main shaft 38. Such material combines advantages of light weight, high strength, good rigidity and non magnetic characteristics. Preferably, all of the transfer drive components are corrosion resistant and will not be degraded by immersion of the system.

Referring now to FIG. 4, the waterjet system of the present invention is shown in a preferred embodiment with curved intake elbow 40 incorporating a pump design that incorporates hydrodynamic technologies related to the hydrodynamic torque converters used in automatic transmissions. The waterjet assembly preferably mounts to the transom of a boat by means of a clamping arrangement 18. The entire reflex waterjet system pivots in a similar fashion as an outboard engine on tubular shaft 44 to provide steering means. Preferably rubber or a similar elastomer is used for sleeves 45 that provide an isolation for noise, shock, and vibration between the propulsion system and the hull of the boat. The resultant steering is far superior than a conventional jet because the available steering angle is 30 to 40 degrees, compared to the 15 to 20 degrees of nozzle deflection of a conventional jet. In addition, the inlet also turns in the reflex waterjet therefore its side plates 46 contribute steering force, rather than resisting turning as found with a conventional jet's fixed intake.

Preferably the mounting has a vertical sliding device 48 with a damper which allows the inlet to maintain a favorable depth under varying hull load and trim conditions. It was found in earlier tests that the dynamic pressure that develops under the inlet when the boat is moving at high speed produces a substantial lifting force. As the hull starts, the inlet will be at its lowest position that assures positive flows of water into the jet pump. As the hull accelerates, the waterjet assembly is lifted by dynamic pressure under the inlet to a position where it rides on the surface of the water, similar to a water-skier. Drag forces from the inlet are reduced by the resulting minimal immersion, thereby improving performance and economy.

Water flows from water inlet 50 positioned at the bottom of the assembly through a convergent elbow 52 to impeller 54. Velocity distribution tests at the impeller inlet have shown a more uniform velocity distribution than conventional water jets. The superior velocity distribution minimizes any localized cavitation at the leading edges of the impeller blades, thus improving pump efficiency while avoiding the noise associated with cavitation.

Impeller blade 56 design is based on torque converter technology. The configuration controls pressure distribution both radially and axially to control cavitation and vortices that waste power by turning energy into noise. Impeller blade 56 is configured to match the volute 58 into which the flow is discharged. Water leaves the impeller with a forced vortex velocity distribution and a discharge angle of 45 to 70 degrees, leaving only a small turn to be made in the transition into volute 58. As seen in FIG. 4 impeller 56 is preferably four bladed to reduce tip speed and noise.

Preferably impeller 56 discharges into a mixed flow volute 58. This configuration offers advantages of small size, light weight, and high efficiency. The discharge from volute 58 is split into two passages that transfer the water to two annular jet outlets 60 which surround exhaust ports 66 as seen in FIG. 2. By this means, the noisy engine exhaust flow is surrounded by a sleeve of water that will contain most of the noise and greatly reduce the noise level in the boat and surrounding environment.

Reverse thrust is obtained by lowering the reverse deflectors 62 to a position where the direction of the jet water flow is reversed. The water then leaves the jet in a forward direction and reverse thrust results. The concept shown incorporates a small notch 64 to clear the exhaust port and to assure that no water is directed into the exhaust.

Steering tiller 30, seen in FIG. 1, is preferably mounted on a pivot pin and clevice so it can be stowed in a lowered position to reduce the overall size of the outboard waterjet when stowed or shipped. A latch is preferably provided to lock it in a normal operating position. Twist throttle 68 controls the engine speed an power, and a small separate forward, neutral and reveres lever is preferably mounted to the transfer case 107 for controlling the direction of thrust and resulting movement.

Recoil starter 70 is preferably mounted to transfer case 107 so the pull cord is readily accessible for the operator. Ignition system and alternator coils are preferably mounted to the opposite end of engine 10 and enclosed in ignition housing 90 seen in FIG. 1.

Figure 5:
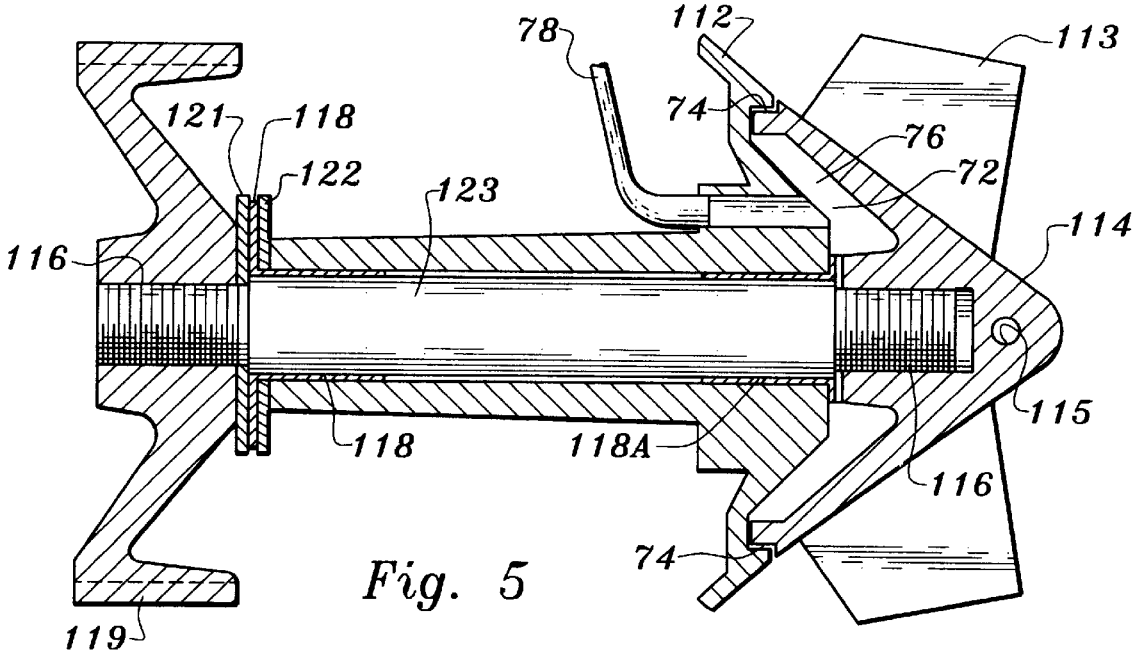
FIG. 5, is a view of the main shaft assembly of such system, according to the invention.

In FIG. 5, water cooling for the main shaft assembly for engine 10 is shown with main waterjet pump including cooling water port 72 provided in volute housing 112 preferably positioned behind impeller hub 114. This location is preferred to minimize entry of any solid contaminates into the engine cooling system. A series of separations follows. first, inlet elbow 40 throws heavier solids towards the upper outside diameter of the inlet. Second a sharp inwardly turned labyrinth 74 separates many of the remaining solids. Finally the fluid 76 between impeller hub 114 and volute housing 112 rotates at about one half the impeller speed to serve as a centrifugal separator. Water is transferred to engine 10 by tube 78. The cooling water from the engine discharges in the exhaust silencer 22 to cause exhaust gases to contract and thus reduces engine exhaust noise. Such high capacity pump provides ample flow to cool engine 10 and exhaust to temperatures below 100 degrees F. to minimize IR signature. Removal hole 115 is in impeller hub 114 with threaded mount 116. A flanged bushing 118 and 118A support and locate main shaft 123 with washer 122. A HTD belt pulley 119 is operably secured to main shaft assembly as illustrated.

With reference to FIG. 5, water under pressure from the pump blades 113 passes through labyrinth 74 and into chamber 76 between the impeller hub and the volute casting 112. The water then passes through grooves on the inner diameter and flanges of flanged bearings 118 and 118A, finally draining into the transfer case, from which it drains to the outside of the propulsion unit. The water transferred to the engine from port 72 via tube 78 is used to cool the engine.

Figure 6:
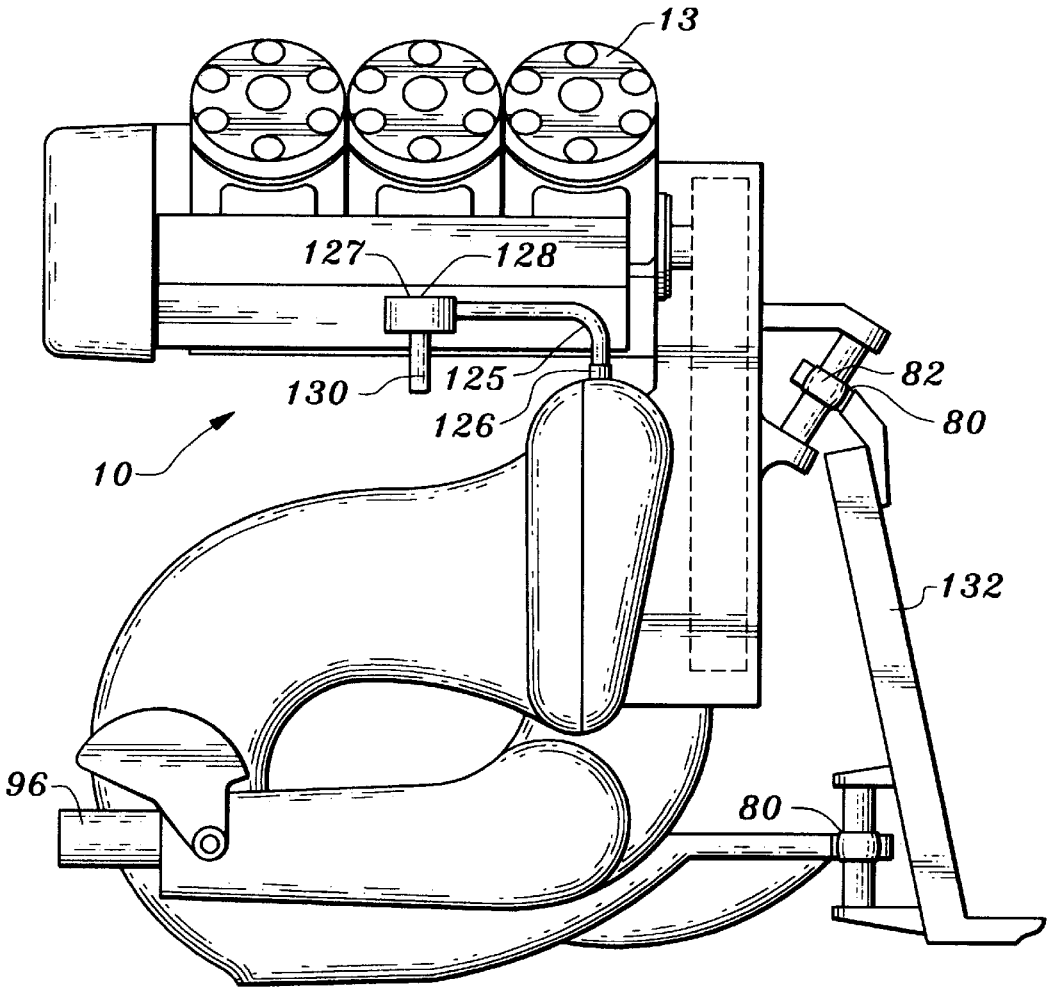
FIG. 6, is a view of the positive prime configuration with slanted pins of such system, according to the invention.

With reference now to FIG. 6, a positive priming system is shown with suction pump 127 with vent line 125 and surge valve 126. Preferably a flexible diaphragm 128 is positioned between the engine crankcase and the pump chamber. Pump 127 is similar to the cam actuated fuel pumps used form many years in cars with carburetors, except that the cam lever is deleted and the pressure fluctuations in the two cycle engine crankcase cause the diaphragm to pulse and move the fluid. Drain 130 drains pump 127. Pump 127 assures positive priming under all operating conditions. FIG. 6 also shown is an alternative mounting means with slanted pins 80 and ball joints 82 operably mounting engine 10 to boat or vessel 132. Such mounting means allow for changing the angle of the drive and the resulting thrust angle as the system is lifted by hydrodynamic pressure under the inlet.

In operation and use the outboard marine propulsion system with engine 10 is very efficient, quiet, and powerful. It is also light weight, of simplified construction, and convenient, easy, reliable, and effective to use on boats and other marine vessels, under all conditions and in both shallow and deep water. Accordingly, additional advantages and modification will readily occur to those skilled in the art. The invention in its broader aspects is, therefore, not limited to the specific details, representative apparatus and illustrative examples shown and described. For example, throughout the disclosure various angles such as 180 degrees and 90 degrees have been used to describe preferred configurations. Such angles could easily be varied by plus or minus 20 degrees depending upon the design detail and the application. Accordingly, departures from such details may be made without departing from the spirit or scope of the applicant's general inventive concept.

What is claimed is:

1. An improved outboard propulsion system for a vessel of the type in which an intake duct is supported for movement between an upward tilt angle and a downward tilt angle, apparatus connected to the duct support defines a reaction center line to urge the duct in a downward tilt angle through a downward progressive thrust, connecting apparatus connected to the duct support and define a thrust center line disposed below the reaction center line to urge the duct in an upward tilt angle through an upward reaction force, a fixed member, and a tilt angle device interconnecting the intake duct and the fixed member for regulating the tilt angle movement of the intake duct in the changeover between an upward tilt angle and the downward tilt angle, wherein the improvement comprises:

an engine having a horizontal crankshaft;

chain transfer drive means for driving a propulsion device, said chain transfer drive means being operably linked to said engine;

a transfer case connecting said engine and said chain transfer drive means, said transfer case enclosing said chain transfer drive means; and an impeller for discharging water into a mixed flow volute, said impeller being operably secured to said engine.

2. The improved outboard propulsion system for a vessel of claim 1, further including means for thrust angle vector positional control.

3. The improved outboard propulsion system for a vessel of claim 1, further including means for automatic thrust vector angle control utilizing a hydraulic damper.

4. The improved outboard propulsion system for a vessel of claim 1, further including a dual nozzle waterjet.

5. The improved outboard propulsion system for a vessel of claim 4, wherein said dual nozzle waterjet includes a pump driven for applying a vacuum at a top portion of a water passage for positive priming.

6. The improved outboard propulsion system for a vessel of claim 1, further including a concentric exhaust outlet operably positioned within one or more waterjet outlets; said concentric exhaust outlet including an aperture in a reverse deflector to avoid forcing water into the exhaust.

7. The improved outboard propulsion system for a vessel of claim 1, wherein said engine having a horizontal crankshaft is mounted to a vessel by a pair of ball joints positioned on a pair of shafts.

8. The improved outboard propulsion system for a vessel of claim 1, further including a pulley for reducing pumping power losses when a transfer case of said engine with a horizontal crankshaft becomes partially or fully flooded with water.

9. An improved outboard propulsion system for a marine vessel of the type in which an intake duct has an intake orifice positioned for receiving water, the intake duct includes a curved flow path directing walls curved continuously to provide a 180 degree turn for the water so as to direct the water flowing in an initial direction to a direction opposite the initial direction, and an annular duct contiguous with the intake duct at the end of the intake duct opposite the intake orifice, wherein the improvement comprises:

an engine with a horizontal crankshaft, belt transfer drive means for driving a propulsion device, said belt transfer drive means being operably linked to said engine; and a transfer case connecting said engine and said belt transfer drive means to a waterjet propulsion unit, said transfer case enclosing said belt transfer drive means; and an impeller for discharging water into a mixed flow volute, said impeller being operably secured to said engine.

10. The improved outboard propulsion system for a marine vessel of claim 9, further including means for thrust angle vector positional control.

11. The improved outboard propulsion system for a marine vessel of claim 9, further including means for automatic thrust vector angle and height control utilizing a hydraulic damper.

12. The improved outboard propulsion system for a marine vessel of claim 9, further including a dual nozzle waterjet.

13. The improved outboard propulsion system for a marine vessel of claim 12, wherein said dual nozzle waterjet includes a pump for applying a vacuum at a top portion of a water passage for positive priming.

14. The improved outboard propulsion system for a marine vessel of claim 9, further including a concentric exhaust outlet operably positioned within one or more waterjet outlets; said concentric exhaust outlet including an aperture in a reverse deflector to avoid forcing water into the exhaust.

15. The improved outboard propulsion system for a marine vessel of claim 9, wherein said engine having a horizontal crankshaft is mounted to a vessel by a pair of ball joints positioned on a pair of shafts.

16. The improved outboard propulsion system for a marine vessel of claim 9, further including a pulley for reducing pumping power losses when a transfer case of said engine with a horizontal crankshaft becomes partially or fully flooded with water.

17. The improved outboard propulsion system for a marine vessel of claim 9, wherein said transfer case is positioned above the surface of water discharging from below a hull of said marine vessel.

* * * * *